US006948709B1

(12) United States Patent
Callsen et al.

(10) Patent No.: US 6,948,709 B1
(45) Date of Patent: Sep. 27, 2005

(54) ASSEMBLED EXPANDING LANCE

(75) Inventors: Christof Callsen, Kaltenkirchen (DE); Martin Krüssmann, Hamburg (DE); Erik Lüllwitz, Hamburg (DE); Hans-Rudolf Siemund, Buxtehude (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/700,371

(22) PCT Filed: May 3, 1999

(86) PCT No.: PCT/EP99/02990

§ 371 (c)(1),
(2), (4) Date: Nov. 15, 2000

(87) PCT Pub. No.: WO99/59747

PCT Pub. Date: Nov. 25, 1999

(30) Foreign Application Priority Data

May 15, 1998 (DE) ..... 198 21 807

(51) Int. Cl.[7] ..... B23B 31/40
(52) U.S. Cl. ..... 269/48.1; 269/22
(58) Field of Search ..... 269/22, 48.1, 48.3; 242/72 R, 72 B; 279/2 A, 4; 294/93, 98.1; 82/44

(56) References Cited

U.S. PATENT DOCUMENTS 3,627,336 A 12/1971 Lawson
4,467,630 A 8/1984 Kelly
4,608,739 A 9/1986 Miller
5,388,814 A 2/1995 Riemscheid et al.

FOREIGN PATENT DOCUMENTS

DE 37 20 487 10/1988
DE 37 16 986 12/1988

*Primary Examiner*—Robert C. Watson
(74) *Attorney, Agent, or Firm*—Crowell & Moring LLP

(57) ABSTRACT

An expansion lance assembly for an expansion of a hollow profile by the exertion of a fluidic high internal pressure. The expansion lance assembly includes a rod-shaped seal carrier detachably connected to a carrier holder and having a seal arrangement including at least two sealing rings. At least one spacer sleeve is situated between the at least two sealing rings and is arranged on the seal carrier. The seal carrier has an axial inflow bore connected to a fluid high-pressure source and at least one transverse bore branching off from the axial inflow bore. To provide that the lance can be used for long periods of time with a reliable seal of the seal arrangement, the expansion lance assembly includes that each of the sealing rings includes a first component and a second component. The first component includes a low-abrasion high-pressure-resistant elastomer ring which bears against a circumferential surface of the seal carrier such that it is elastically deformable axially by high internal pressure. The second component includes a high-pressure-resistant supporting ring which is radially elastic and axially has a high tensile strength. Furthermore, the elastomer ring includes, on a side facing away from a nearest transverse bore, a peripheral shoulder on which the supporting ring is mounted.

17 Claims, 1 Drawing Sheet

ASSEMBLED EXPANDING LANCE

BACKGROUND AND SUMMARY OF THE INVENTION

The invention relates to an expansion lance.

An expansion lance of the generic type is known from DE 37 16 986 A1 (corresponding to U.S. Pat. No. 5,054,756). In this case, a rod-shaped seal carrier has a sealing arrangement pushed onto it. (FIG. 2), the said sealing arrangement comprising spacer sleeves, pairs of sealing rings and intermediate sleeves, the latter being arranged between the sealing rings of the pairs. The sealing rings are supported on the other hand against the spacer sleeves or an end stop. In the case of an expansion lance of this type, in which, in the position in which it has been pushed into a pipe to be expanded, the sealing rings bear against the inside of the pipe with prestress, the sealing rings are pressed into the gap between the spacer sleeves adjoining the sealing rings, or the end stop, and the pipe when a high internal pressure is applied, intended to bring about a partial expansion of the pipe, after which the respective ring undergoes extrusion through the gap. This causes irreparable damage to the ring, which may lead immediately to leakage of the sealing arrangement. What is quite sure, however, is that the extruded ring must be exchanged before a subsequent expanding process is carried out by means of the expansion lance, so there can be no question of the expansion lance being capable of being used over long periods. FIGS. 5a and 6a of the document show versions of the sealing arrangement in which the sealing rings in the form of O-rings are placed in receiving grooves, the O-rings having to be stretched over a special spacer sleeve to assume their intended place. Furthermore, although the O-rings have supporting elements on the side facing away from the expansion location, there is a gap both between the supporting element and the pipe to be expanded and between the latter and the O-ring, as a result of which no sealing effect exists during the build-up of the high internal pressure via the gap. Although under high internal pressure the O-ring is deformed until it bears against the inside of the pipe, the ring is squeezed into the gap between the supporting element and the pipe in spite of the support (FIG. 5a). In this case, extrusion of the ring through the gap likewise occurs to a certain extent. In the version of FIG. 6a, the supporting ring itself may be extruded, after which the O-ring is extruded. Consequently, the expansion lance cannot be used over long periods. This similarly applies to the versions of FIGS. 7 and 8, the O-rings not primarily having a sealing function here but instead serving as pressure transferring means for the supporting element and being intended to press the latter against the inside of the pipe for applying the sealing effect. In this case, however, the admission pressure in the region 9 must be just as great as the joining pressure in the expansion region, since otherwise the O-ring is pressed into the bore lying thereunder. If the joining pressure is greater, the bore under the O-ring acts like a punching ring, which destroys the O-ring. If there is pressure equalisation, at the customary rates of pressure increase of approximately 2000 bar/sec the bore under the O-ring acts like a nozzle, which blasts the O-ring with the pressurized fluid. Since the supporting element is subjected directly to the pressure medium and the force resulting from the two compressive forces has an axial component, the supporting element may either easily jam in the gap between the spacer sleeve and the hollow profile or even be extruded into it.

The invention is based on the object of providing an expansion lance that can be used over long periods while ensuring a reliable sealing effect of the sealing arrangement.

The object is achieved according to the features of the present invention.

Thanks to the invention, the sealing arrangement of the expansion lance has a priori as a result of the oversize of the elastomer sealing ring with respect to the inside diameter of the hollow profile to be partially expanded an adequate sealing effect during the pressure build-up phase. In this case, the low- abrasion material of the sealing ring contributes significantly to ensuring that the expansion lance can be used over long periods. On account of the axially immovable stop, when there is full expansion pressure the elastomer ring is axially compressed, after which the axially unyielding, but radially elastic supporting ring is radially expanded by the radially swelling shoulder until it is pressed against the inside of the hollow profile. There is accordingly no gap between the hollow profile and the sealing ring into which the elastomer ring could flow, i.e. be extruded, thereby avoiding sealing damage and consequently consolidating the long-term service life of the expansion lance. The elastomer ring cannot flow away at any other point either, since its shoulder is always enclosed by the supporting ring, the seal carrier and the stop. At the same time, the fact that the elastomer ring does not flow away ensures the sealing effect during the expansion of the hollow profile subjected to high internal pressure.

Other objects, advantages and novel features of the present invention will become apparent from the following detailed description of the invention when considered in conjunction with the accompanying drawings.

DETAILED DESCRIPTION OF THE DRAWINGS

Figure 1:
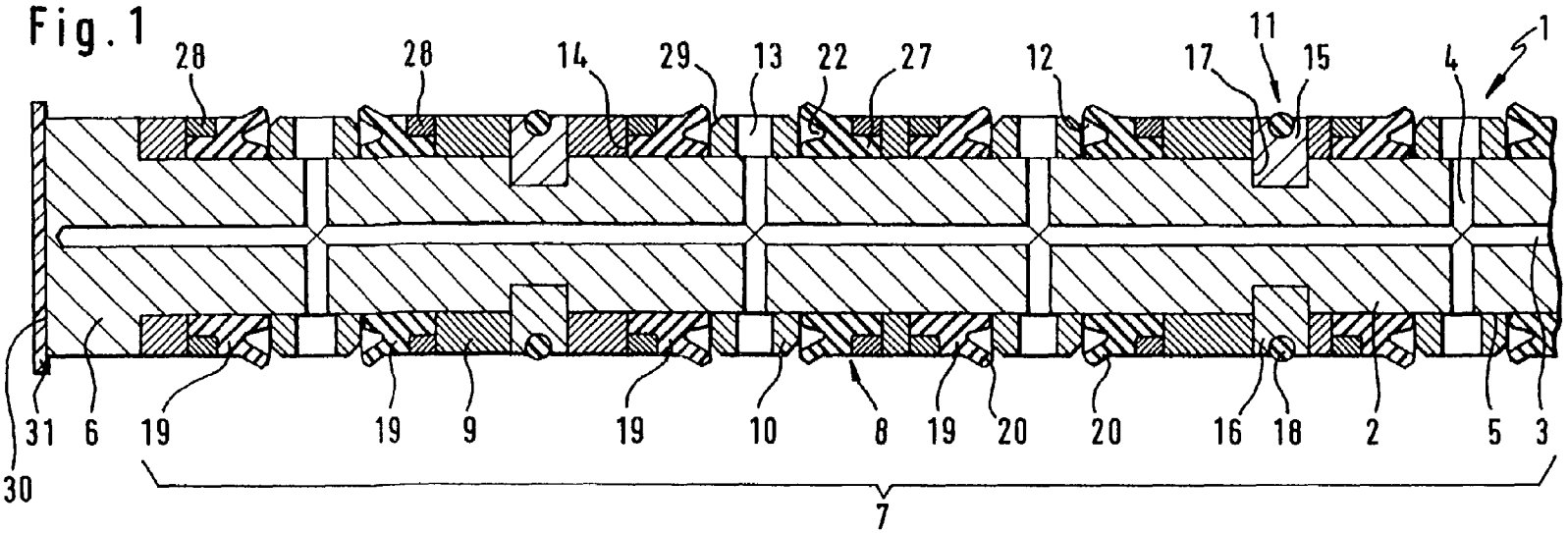
FIG. 1 shows a portion of an expansion lance according to the invention in a lateral longitudinal section.

Represented in FIG. 1 is an expansion lance assembly 1, with which a straight-running tubular hollow profile can be partially expanded by exertion of a fluidic high internal pressure after the expansion lance has been pushed in and suitably positioned within the hollow profile, in order for example to join cams onto the hollow profile to form a camshaft.

The expansion lance 1 comprises a rod-shaped seal carrier 2, which is detachably attached, preferably screwed, onto a carrier holder. The seal carrier 2 has a centrally running axial inflow bore 3, from which transverse bores 4 branch off at specific intervals, adapted to the placement of the cams to be joined on the hollow profile, and open out at the point of the hollow profile expansion to be formed. The inflow bore 3 on the one hand has connected to it a fluid high-pressure source for charging the inflow bore 3, and consequently the expansion point, with a pressurized fluid. On the other hand, the inflow bore 3 is designed as a blind-hole bore, which runs out in an upset portion 6 of the seal carrier 2, which forms the end of the latter. The upset portion 6 serves as an end stop for a sealing arrangement 7, which can be pushed in a simple way onto the seal carrier 2, without the seals of the arrangement 7 being stretched inordinately, entailing damage to the seal.

Figure 2:
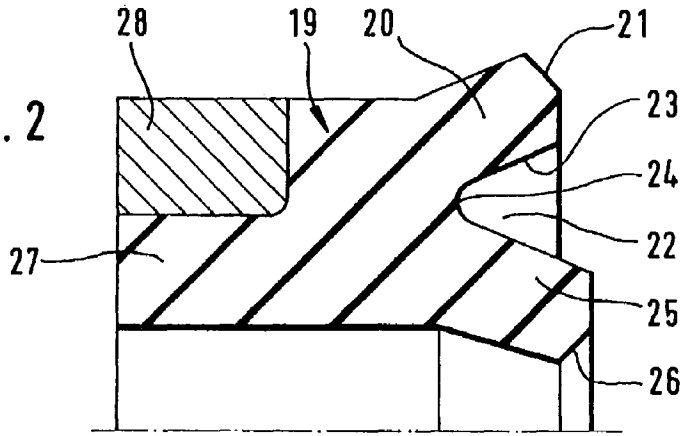
FIG. 2 shows a sealing ring of the sealing arrangement of the expansion lance according to FIG. 1 in a lateral longitudinal section.

The sealing arrangement 7 comprises sealing rings 8, as can be seen in particular from FIG. 2, spacer sleeves 9, intermediate sleeves 10 and positioning stops 11.

The sealing rings 8 are respectively provided as a pair of sealing rings and are arranged at the point of the expansion lance 1 at which the expansion of the hollow profile is to take place. The spaced-apart sealing rings 8 of the pair of sealing rings in this case axially bound the expansion point on both sides in such a way that it is sealed against high pressure, so that an annular expansion chamber 12 is formed between the sealing rings 8. The expansion chamber 12 is virtually filled with in each case an intermediate sleeve 10, which has radial bores 13 which adjoin the mouth openings of the transverse bores 4 of the expansion lance 1 in such a way that they are aligned with the bores 4. On the side 14 facing away from the intermediate sleeve 10, the sealing rings 8 are supported by an axial stop, which is designed as a spacer sleeve 9. This serves at the same time as a line filler for axially positioning the sealing rings 8 along the expansion lance 1.

The spacer sleeve 9 in turn is supported on the other hand axially against a positioning stop 11, which is fastened axially immovably on the seal carrier 2. The stop 11 absorbs the axial force which originates on the one hand from the high internal pressure exerted in the expansion chamber 12 and on the other hand from the frictionally induced insertion forces when the expansion lance 1 is pushed into the hollow profile, so that no axial displacement of the sealing rings 8 and of the spacer sleeves 9 occurs under the effect of the compressive force. The positioning stop 11, which does not necessarily have to support every spacer sleeve 9—two pairs of sealing rings lying next to each other may also be supported against a common spacer sleeve 9 lying between the pairs—is formed in an easy-to-assemble way by two ring halves 15, 16, which are accommodated in an annular groove 17 of the seal carrier 2 to form a full ring. In their inserted position, the ring halves 15, 16 protrude radially out of the annular groove 17, being held together against each other at their circumference by a torsionally flexible elastomeric ring 18.

The upset portion 6 may also be replaced by a positioning stop 11 formed in such a way, whereby the seal carrier 2 can be formed with less expenditure in terms of technical production, namely as a simple cylindrical rod. Then, to ensure the tightness of the seal of the expansion lance 1 in its end region, that is to say in the region of the positioning stop 11, the inflow bore 3 is welded closed.

The sealing rings 8 are formed with oversize at the outside diameter with respect to the inside diameter of the hollow profile, so that when the expansion lance 1 is pushed into the hollow profile a sealing effect is immediately obtained by the sealing rings 8 bearing with prestress against the inside of the hollow profile. Furthermore, the sealing rings 8 in each case comprise two components, the first component being formed by a low-abrasion high-pressure-resistant elastomer ring 19, which bears against the circumferential surface 5 of the seal carrier 2.

The elastomer ring 19 can consequently be axially subjected fully to the high internal pressure and can be elastically deformed in its entirety. It preferably consists of a hydrolysis-resistant thermoplastic polyurethane elastomer, its low abrasion during pushing into and pulling out of the hollow profile guaranteeing a high long-term durability. It is possibly also conceivable for the elastomer ring 19 to be formed from a textile material, in particular an aramid braid.

The elastomer ring 19 has a peripheral sealing lip 20 which protrudes radially outwards from its outer circumference and has a much greater outside diameter than the inside diameter of the hollow profile to be expanded. The radially outwardly protruding, spread-away sealing lips 20 of the two sealing rings 8 of the pair of sealing rings are inclined towards each other, as a result of which, when the expansion lance 1 is pushed into the hollow profile, the sealing lips 20 are bent by the latter strongly towards the seal carrier 2, so that the prestress of the sealing rings 8 in the hollow profile, and consequently the sealing effect, is increased. In addition, the sealing lips 20 bridge the gap, increasing during the expansion, between the expansion lance 1 and the hollow profile by elastically springing back into their initial position, corresponding to the not-in-use position of the expansion lance 1. In this case, relatively large gaps can be bridged in such a way that they are sealed against high pressure in an advantageous way. Furthermore, the outside dimensions of the other component parts of the sealing arrangement 7 can be reduced without loss of a sealing effect, so that jamming of the expansion lance 1 in the hollow profile during the pushing in and/or during the action of the high internal pressure, during which distortions of the seal carrier 2 can occur, can be prevented. The design of the sealing lips 20 also has the effect of technically facilitating the production of the sealing arrangement 7, since much greater production tolerances are permissible with the reduced diameter of the expansion lance 1. The inclination of the sealing lip 20 also brings the advantage that, when a high internal pressure is exerted, the lips 20 are additionally pressed radially against the inside of the hollow profile with an extremely high force, whereby on the one hand the sealing capability of the sealing arrangement is increased considerably and on the other hand this contributes considerably to avoiding extrusion of the sealing ring 8 into the gap between the non-expanded-region of the expansion lance 1 and the hollow profile.

For better threading of the sealing lips 20 into the hollow profile and for avoiding breaking off of the trailing sealing ring 8 in the pushing-in direction of the expansion lance 1 when the expansion lance 1 is pushed in or of the leading sealing ring 8 in the pushing-in direction of the expansion lance 1 when the expansion lance 1 is pulled out after the forming operation, the sealing lip 20 has on the side of the intermediate sleeve 10 a peripherally chamfered radially outward-facing bevel 21 (FIG. 2).

Incorporated in the elastomer ring 19 is a notch-shaped annular groove 22, which is open in the axial direction towards the intermediate sleeve 10 and the outer flank of which forms the underside 23 of the sealing lip 20. The annular groove 22 gives the sealing lip 20 adequate elasticity to be able to spring back appropriately during the expansion of the hollow profile to ensure adequate sealing capability. In this case, the depth of the annular groove 22 should not be made so great that there is the risk of the sealing ring 8 tearing, but great enough to ensure adequate elasticity of the sealing lip 20. Groove depths of between 2 and 2.3 mm have been found to be particularly favourable here. The groove base 24 is, moreover, rounded for technical stress-related reasons, whereby the notch stress of the annular groove 32 is reduced and the strength of the sealing ring 8 is increased.

The elastomer ring 19 also has a peripheral sealing lip 25 which protrudes radially inwards from its inner circumference and bears against the seal carrier 2 with prestress, avoiding creeping of the high-pressure fluid under the sealing ring 8 and consequently the formation of a leak. The sealing effect is consequently increased by the sealing lip 25. In the same way as the sealing lip 20, the radially inwardly protruding sealing lips 25 of the two sealing rings 8 of the pair of sealing rings are inclined towards each other, whereby the sealing lips 25 are pressed very strongly against the seal carrier 22 under high internal pressure and improve the sealing effect still further.

The sealing lip 25 has a peripherally chamfered radially inward-facing bevel 26, which facilitates the threading onto the seal carrier 2 for the trailing sealing ring 8 of the pair of sealing rings in the pushing-in direction of the expansion lance 1, and prevents breaking off of the sealing lip 25 when threading on, and prevents breaking off for the leading sealing ring 8 in the pushing-in direction of the expansion lance 1 when pulling off from the seal carrier 2, for example for the purpose of replacement.

Formed on the elastomer ring 19, on the side 14 of the latter facing away from the nearest transverse bore 4, is a peripheral, cross-sectionally rectangular shoulder 27, onto which a supporting ring 28 forming the abovementioned second component of the sealing ring 8 is mounted with a press fit. The supporting ring 28 mounted in such a way consists of high-pressure-resistant material, is radially elastic and has a very high tensile strength in the axial direction. Bronze or a spring steel is conceivable as the material for the supporting ring 28. The use of a linear aromatic polymer or a polyoxymethylene thermoplastic has been found to be particularly favourable with respect to satisfying the requirements to be met by the supporting ring 28. The shoulder 27 of the sealing ring 8 is consequently enclosed by the supporting ring 28, the seal carrier 2 and the adjacent spacer sleeve 9.

If a high internal pressure is then built up, on the one hand the sealing lip 20 is pressed against the hollow profile and on the other hand the elastomer ring 19 is axially subjected to the fluid. In this case, the said ring is compressed between the spacer sleeve 9 and the pressurized fluid and, as a result, ring material is additionally pressed under the supporting ring 28, which radially expands, driven as it were by the swelling shoulder 29 of the elastomer ring 19, and presses itself against the hollow profile. As a result, the gap between the expansion lance 1 and the hollow profile is closed directly behind the expansion region, the elastomer ring 19 having no possibility of being extruded into the gap and destroyed in this way, with loss of sealing capability. The supporting ring 28 is very stiff in the axial direction and therefore cannot be pressed away or even extruded itself. Consequently, the supporting ring 28 achieves a reliable sealing effect for the sealing arrangement 7 and ensures that the expansion lance 1 can be used over long periods. To prevent any creeping under the spacer sleeve 9 by the shoulder 27 of the elastomer ring 19, the sleeve 9 is arranged with a snug fit on the seal carrier 2.

The intermediate sleeve 10, keeping the two sealing rings 8 of the pair of sealing rings apart and supporting them axially, virtually fills the expansion chamber 12, as mentioned, in order to lose as little pressurized fluid as possible when the expansion lance 1 is pulled out from the hollow profile after expansion has taken place. In order that the pressurized fluid can flow to an adequate extent via the radial bores 13 into the annular groove 22 for the compression of the elastomer ring 19 and for the spreading of the sealing lips 20 and 25, the intermediate sleeve 10 is provided on the outside with a bevel 29 on both end faces.

A flexible stripping ring 31, which has a greater diameter than the inside diameter of the hollow profile, is attached, preferably adhesively attached, onto the end face 30 of the upset portion 6 of the seal carrier 2, ahead of the sealing arrangement 7 in the pushing-in direction of the expansion lance 1. The stripping ring 31 serves for displacing particles, chips and loose burr in the hollow profile, so that the sealing rings 8 have a clean contact when they come to bear in their position for use in the hollow profile, which is important for the sealing capability of the sealing arrangement 7. Furthermore, the sealing rings 8 are not scratched by the small particles mentioned and therefore do not suffer any damage, so that this aspect also contributes to the ability of the expansion lance 1 to be used over long periods.

The seal carrier 2 consists, moreover, of a hardened and tempered steel with a high yield strength and high tensile strength with at the same time a high elongation at fracture, with the effect of reducing the growing axial loading due to the pressure increasing and decreasing, which lowers the tensile strength of the seal carrier 2 during its use, in particular whenever it has a very small diameter. The tensile strength then becomes so low that the seal carrier 2 ruptures. The sealing effect would in this case be lost. The hardening and tempering decisively counteract this harmful effect. The seal carrier 2, produced from originally normal tool steel (for example 60 WCrV 7) is subjected to a suitable heat treatment for this purpose. For example, the steel is austenitized in a furnace at 880° C. for a heat exposure period of approximately 25 minutes and is then cooled from the heat of the furnace to room temperature in oil. Subsequently, the steel is annealed for 2 hours at 600° C., after which it has a yield strength of approximately 1340 $N/mm^2$ and a tensile strength of approximately 1410 $N/mm^2$ with an elongation at fracture A5 of approximately 8%. As an alternative to this steel, a heat-treatable steel such as 30 CrNiMo 8, which is extremely tough, can conceivably be used. On account of the hardening and tempering of the seal carrier 2, very stiff sealing elements of the sealing arrangement 7, such as metal spacer sleeves 9 and supporting rings 28, can also be used, since bending of the seal carrier 2 does not occur during the expansion.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An expansion lance assembly for an expansion of a hollow profile by the exertion of a fluidic high internal pressure comprising:

a rod-shaped seal carrier detachably connected to a carrier holder and having a seal arrangement including at least two sealing rings each having an outside diameter which is larger than an inside diameter of the hollow profile and at least one spacer sleeve situated between the at least two sealing rings and arranged on the seal carrier, the seal carrier having an axial inflow bore connected to a fluid high-pressure source and at least one transverse bore branching off from the axial inflow bore and the seal arrangement having an axial end support situated remote from the carrier holder;

wherein each of the sealing rings includes a first component and a second component;

the first component including a low-abrasion high-pressure-resistant elastomer ring which bears against a circumferential surface of the seal carrier such that it is elastically deformable axially by high internal pressure from the pressure source, the second component including a high-pressure-resistant supporting ring which is radially elastic and axially has a high tensile strength, wherein the elastomer ring includes, on a side facing away from a nearest transverse bore, a peripheral shoulder on which the supporting ring is mounted, the peripheral shoulder being enclosed by the supporting ring, and the seal carrier and an axial stop being arranged on the peripheral shoulder.

2. The expansion lance according to claim 1, wherein the elastomer ring includes a hydrolysis-resistant thermoplastic polyurethane elastomer.

3. The expansion lance according to claim 1, wherein the supporting ring includes one of a linear aromatic polymer and a polyoxymethylene thermoplastic.

4. The expansion lance according to claim 1, wherein the axial stop is formed by a spacer sleeve which is arranged with a snug fit on the seal carrier.

5. The expansion lance according to claim 1, wherein the spacer sleeve is axially supported on a side facing away from the sealing ring against a positioning stop axially fixed on the seal carrier.

6. The expansion lance according to claim 5, wherein the positioning stop includes two ring halves which are accommodated in an annular groove of the seal carrier and form a full ring, the two ring halves protruding radially out from the annular groove and being held together at their circumference by an elastomeric ring.

7. The expansion lance according to claim 1, wherein the elastomer ring includes a peripheral sealing lip which protrudes radially outwardly from an outer circumference of the elastomer ring and includes a larger outside diameter than the inside diameter of the hollow profile to be expanded.

8. The expansion lance according to claim 7, wherein the radially outwardly protruding sealing lips of two sealing rings are inclined towards each other.

9. The expansion lance according to claim 7, wherein the sealing lip of a trailing sealing ring of two sealing rings relative to a pushing-in direction of the expansion lance, includes on a side of the sealing ring ahead of it a peripherally chamfered radially outward-facing bevel.

10. The expansion lance according to claim 7, wherein the elastomer ring has on a side facing away from the supporting ring a circumferential groove, which is open in an axial direction and the upper flank of which forms an underside of the sealing lip.

11. The expansion lance according to claim 10, wherein the groove is between 2 and 2.3 mm deep.

12. The expansion lance according to claim 10, wherein the groove is of a notch-shaped form, and a groove base is rounded.

13. The expansion lance according to claim 1, wherein the elastomer ring has a peripheral sealing lip which protrudes radially inwards from an inner circumference of the elastomer ring and bears against the seal carrier with a prestress.

14. The expansion lance according to claim 13, wherein the radially inwardly protruding sealing lips of two sealing rings are inclined towards each other.

15. The expansion lance according to claim 13, wherein the sealing lip of a trailing sealing ring of two sealing rings relative to a pushing-in direction of the expansion lance, includes on a side of the sealing ring ahead of it, a peripherally chamfered radially inward-facing bevel.

16. The expansion lance according to claim 13, wherein a flexible stripping ring, which has a greater diameter than the inside diameter of the hollow profile, is attached onto the seal carrier, ahead of the sealing arrangement relative to a pushing-in direction of the expansion lance.

17. The expansion lance according to claim 1, wherein the seal carrier includes a hardened and tempered steel.

* * * * *